United States Patent [19]

Hlinsky

[11] Patent Number: 4,743,150

[45] Date of Patent: May 10, 1988

[54] ELEVATABLE HITCH ASSEMBLY WITH LATERAL SLOT FOR TRAILER ON FLATCAR

[75] Inventor: Emil J. Hlinsky, Oak Brook, Ill.

[73] Assignee: Holland Company, Chicago Heights, Ill.

[21] Appl. No.: 42,891

[22] Filed: Apr. 27, 1987

Related U.S. Application Data

[63] Continuation of Ser. No. 890,880, Jul. 28, 1986, abandoned, which is a continuation of Ser. No. 614,103, May 24, 1984, abandoned.

[51] Int. Cl.[4] ..... B60P 7/13; B60P 3/07

[52] U.S. Cl. ..... 410/64; 410/56; 410/3

[58] Field of Search ..... 410/1, 2, 3, 44, 52–54, 410/56–66, 77, 80, 84, 90, 91; 280/433, 434

[56] References Cited

U.S. PATENT DOCUMENTS

| | | | |
|---|---|---|---|
| 2,355,042 | 8/1944 | Billings | 280/434 |
| 2,423,743 | 7/1947 | Walther et al. | 280/434 |
| 3,112,040 | 11/1963 | Levitt et al. | 410/1 X |
| 3,202,390 | 8/1965 | Sherrie et al. | 410/64 X |
| 3,297,178 | 1/1967 | Bohlen | 410/1 X |
| 3,352,438 | 11/1967 | Davidson | 410/52 X |
| 3,521,572 | 7/1970 | Hamilton | 410/1 X |
| 3,647,248 | 3/1972 | Ferris et al. | 410/64 |

FOREIGN PATENT DOCUMENTS

| | | | |
|---|---|---|---|
| 1163735 | 2/1964 | Fed. Rep. of Germany | 410/1 |

*Primary Examiner*—Johnny D. Cherry

*Assistant Examiner*—Scott H. Werny

*Attorney, Agent, or Firm*—Mann, McWilliams, Zummer & Sweeney

[57] ABSTRACT

A hitch assembly for securing a forward end portion of a semi-trailer carried on a platform such as a railroad flat car includes a support bed having an upper surface for supporting engagement with a bearing surface around a kingpin on the semi-trailer. The depending kingpin of the semi-trailer is seatable within a central aperture formed in the bed and positioned adjacent the intersection of a central longitudinal axis and a lateral axis of the trailer when in position on the railroad car. The aperture is defined to include fixed forward and rearward surfaces for direct stopping engagement with an anlarged kingpin tending to move forwardly or rearwardly along the longitudinal axis. A lateral entry/exit slot is provided in the bed between one side of the central aperture and an adjacent outer edge for guiding the kingpin of the semi-trailer into and out of the central aperture of the bed. A latch mechanism is mounted on the support bed for retaining the kingpin in latched engaged condition in the aperture and is movable between a latching positon and an unlatched position permitting the kingpin to be withdrawn laterally out of the slot entry. Inward movement of the kingpin along the slot into the central aperture is permitted even though the latch is in the latching position extending across the slot, but after the kingpin is seated in the central aperture of the bed, the latch is effective to retain the kingpin latched in seated engagement until deliberate unlatching is accomplished.

10 Claims, 3 Drawing Sheets

FIG. 1
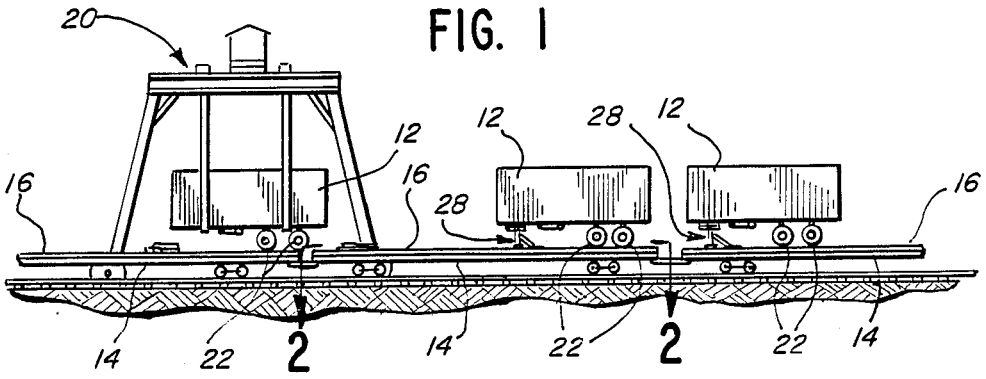
FIG. 2
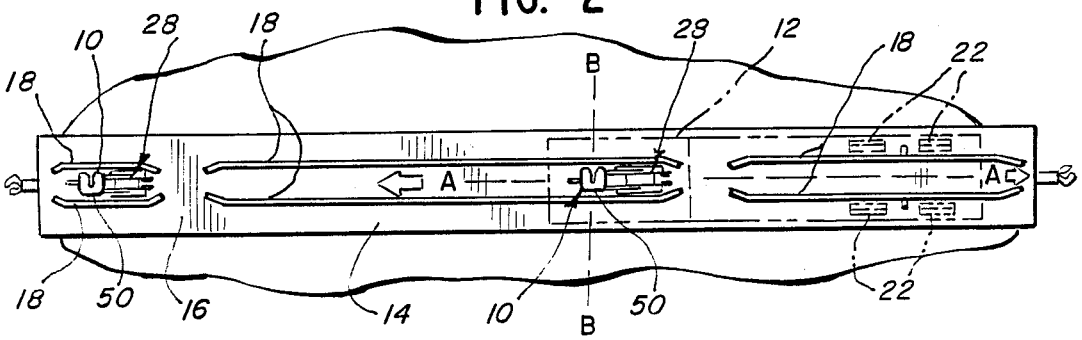
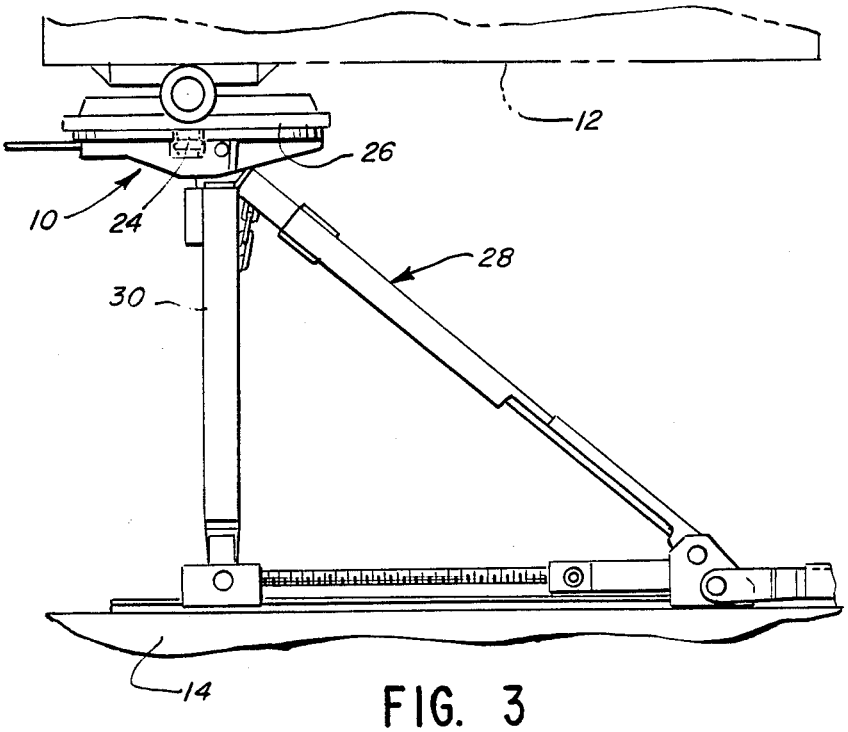
FIG. 3

FIG. 4
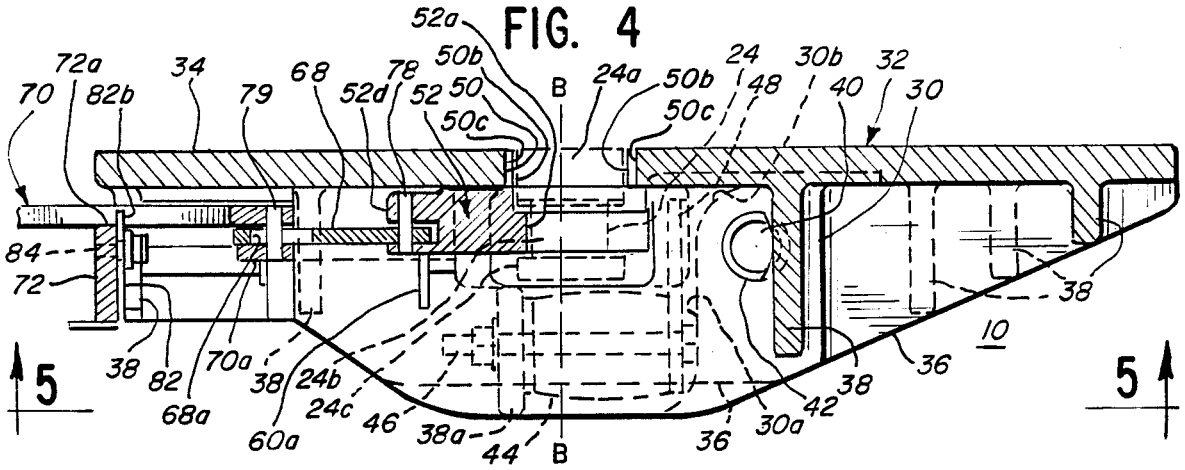
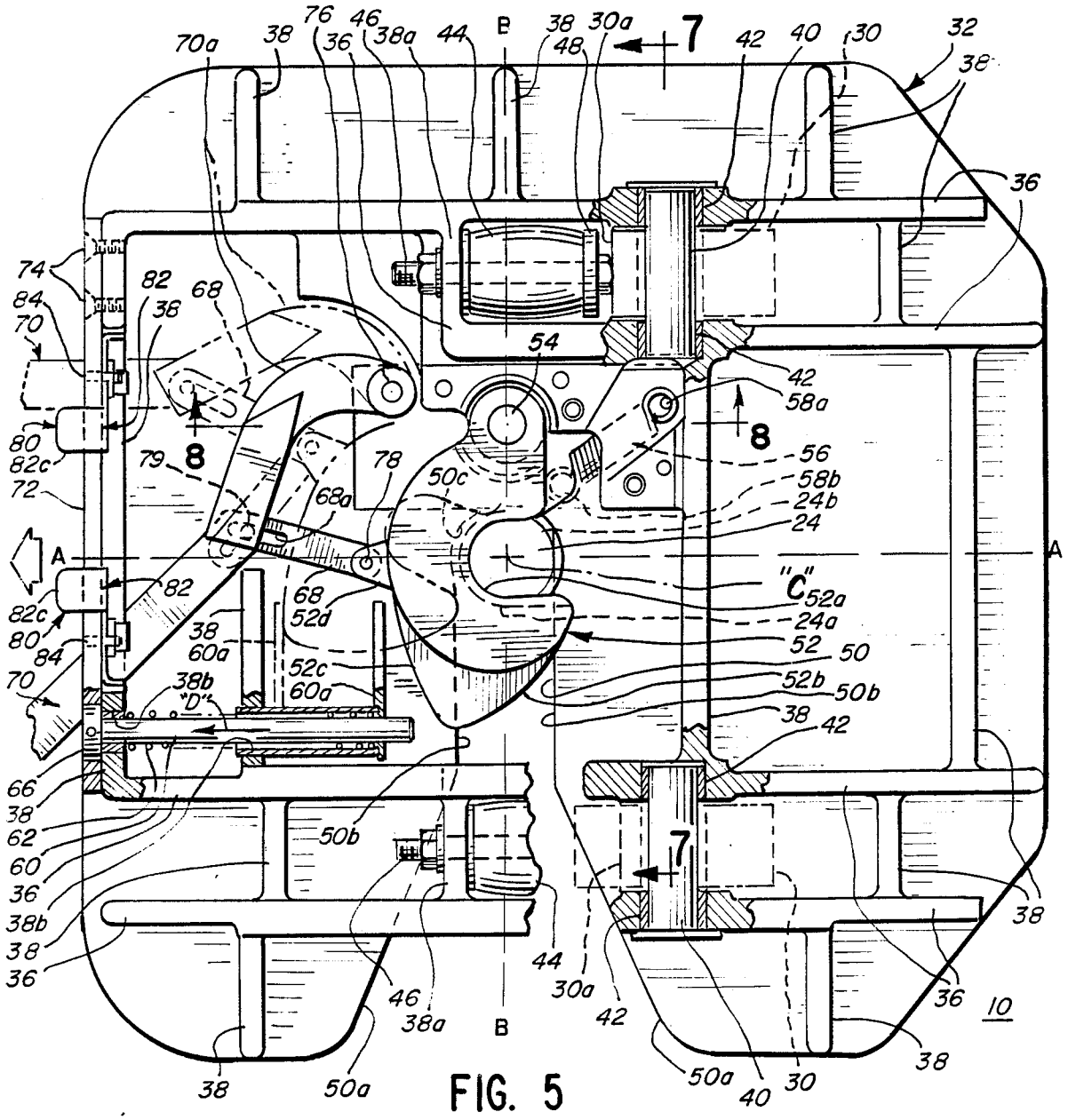
FIG. 5

ELEVATABLE HITCH ASSEMBLY WITH LATERAL SLOT FOR TRAILER ON FLATCAR

This application is a continuation of my application Ser. No. 890,880, filed July 28, 1986, now abandoned, which was a continuation of my now abandoned application Ser. No. 614,103, filed May 24, 1984.

BACKGROUND OF THE INVENTION

1. Field of the Invention

The present invention relates to a hitch assembly for semi-trailers mounted on a platform such as a railroad flat car. More particularly the invention relates to a hitch assembly adapted for positively securing the forward end portion of a semi-trailer for travel on a moving flat car piggyback fashion with the depending kingpin of the trailer in detachable locking engagement with the hitch assembly. The hitch assembly is mounted on a carriage mechanism adapted to elevate a support bed into an operative position at the proper level above the platform of the flat car for engagement with a semi-trailer. The carriage mechanism is collapsible into lowered position adjacent the surface of the platform when not in use and/or prior to the final positioning of a semi-trailer on the railway car for transport.

2. Description of the Prior Art

Over the road motor tractor trailer combinations have been widely used for hauling freight. The trailer or van component of a tractor trailer combination may be disconnected from the tractor and is self supporting for loading, unloading and/or storage or other stationary usage. These trailers or vans are commonly provided with a relatively large downwardly facing bearing plate with a depending kingpin at the center for connection and disconnection with a hitch assembly on the truck or tractor of the combination.

Piggyback operations have grown up utilizing these vans or trailers positioned on railroad cars or flat cars and secured in position thereon for transport over railroad right-of-ways to provide a more economical basis of transportation for goods. A wide variety of hitch mechanisms and supports therefore mounted on piggyback flat cars have been provided by companies such as Pullman Standard, ACF and Flexivan. U.S. Pat. Nos. 3,035,081; 3,127,142; 3,185,421; 3,289,987; 3,348,502; 3,358,945; 3,358,955; and 4,225,276 disclose various piggyback systems for semi-trailers including hitch assemblies, latch systems and support mechanisms for securing trailers in place on flat cars for transport.

Pullman Standard has developed models LP-1, 2, 3, and 4 of a pullup trailer hitch and an inspection and maintenance manual is provided for these hitches. A typical piggyback flat car with hitches thereon is illustrated on page 240 of the Car and Locomotive Encyclopedia.

One of the problems associated with many trailer on flat car hitches is the fact that extremely high loads are present on the latch mechanism which must be capable of restraining movement of a kingpin longitudinally of the semi-trailer. This has resulted in complicated jaw mechanisms such as screw operated jaws shown in U.S. Pat. No. 4,225,276 or a rotary latch mechanism shown in U.S. Pat. No. 3,358,955.

OBJECTS OF THE INVENTION

It is an object of the present invention to provide a new and improved hitch assembly for trailers mounted on flat cars wherein the trailer kingpin is introduced from one side of a bed and is restrained in a longitudinal direction by fixed bed surfaces rather than surfaces on a movable latch assembly.

Another object of the present invention is to provide a new and improved hitch assembly of the character described having a lateral entry of the kingpin and a central aperture with fixed surfaces extending transversely across the longitudinal axis of the trailer for handling longitudinally exerted loads exerted by the kingpin.

Another object of the present invention is to provide a new and improved hitch assembly of the character described which permits automatic entry of a kingpin with a latch mechanism in a closed or an open position.

Still another object of the present invention is to provide a hitch assembly wherein kingpin exit is possible after latching engagement only if a latch mechanism is manually released.

Still another object of the present invention is to provide a new and improved hitch assembly of the character described which includes a visual indicator for indicating the position of a latch mechanism.

Yet another object of the present invention is to provide a new and improved hitch assembly of the character described which includes a manual operator for a latch mechanism which is readily accessible and can be secured in both a latching and unlatched position.

BRIEF SUMMARY OF THE INVENTION

The foregoing and other objects and advantages of the present invention are accomplished in a new and improved hitch assembly for securing the forward end portion of a semi-trailer carried on a platform such as a railroad car which hitch assembly includes a support bed having an generally planar upper surface for supporting engagement with a corresponding bearing surface of the semi-trailer around the kingpin of the semi-trailer. The depending kingpin of the semi-trailer is seated within a central aperture formed in the hitch assembly support bed and positioned adjacent the intersection of a central longitudinal axis and a lateral axis of the trailer when in position on the flat car. The aperture for the kingpin is defined to include fixed forward and rearward surfces of the hitch assembly support bed for direct stopping engagement with the kingpin when engaged therein and as such fixed surfaces are formed by the hitch assembly bed, they are extremely strong for taking large loads imposed by the kingpin as the trailer tends to move forwardly or rearwardly on the flat car during movement of the train. A lateral entry and exit slot is provided in the support bed between one side of the central kingpin aperture and an adjacent outer edge of the bed. The lateral slot permits guiding entry of the kingpin into and out of the central aperture as semi-trailers are loaded and unloaded on the platform of a flat car. The latch mechanism is mounted on the support bed below the plane of its said upper surface for retaining an engaged kingpin in the bed aperture and is movable between a latching position and an unlatching position permitting the kingping to be withdrawn laterally out of the slot. Inward entry movement of the kingpin along the slot into the central aperture is permitted even though the latch is in the latching position and extends across the slot. Once the kingpin is seated within the central aperture, however, the latch is effective to retain the seated engagement until deliberate unlatching is accomplished by movement of the latch to the unlatched position.

BRIEF DESCRIPTION OF THE DRAWINGS

For better understanding of the present invention reference should be had to the following detailed description taken in conjunction with the drawings in which:

FIG. 1 is a side elevational view of a plurality of railroad flat cars with semi-trailers mounted thereon and supported in latched condition by means of hitch assemblies in accordance with the present invention;

FIG. 2 is a top plan view of a railroad flat car on which is mounted a plurality of hitch assemblies constructed in accordance with the features of the present invention;

FIG. 3 is an enlarged side elevational view of a hitch assembly in accordance with the present invention shown in an elevated position for latching engagement with the kingpin of a semi-trailer mounted on the flat car;

FIG. 4 is a longitudinal cross sectional view of one of the support beds of the hitch assembly as arranged in accordance with the present invention, taken substantially along axis "A—A" of FIG. 5 and viewing the bed in the direction of its kingpin entry slot;

FIG. 5 is a bottom plan view of the support bed shown in FIG. 4, looking in the direction of the arrows 5—5 of FIG. 4, and showing the underside of the support bed, but with parts broken away and parts shown in section;

BRIEF DESCRIPTION OF A PREFERRED EMBODIMENT

Figure 6:
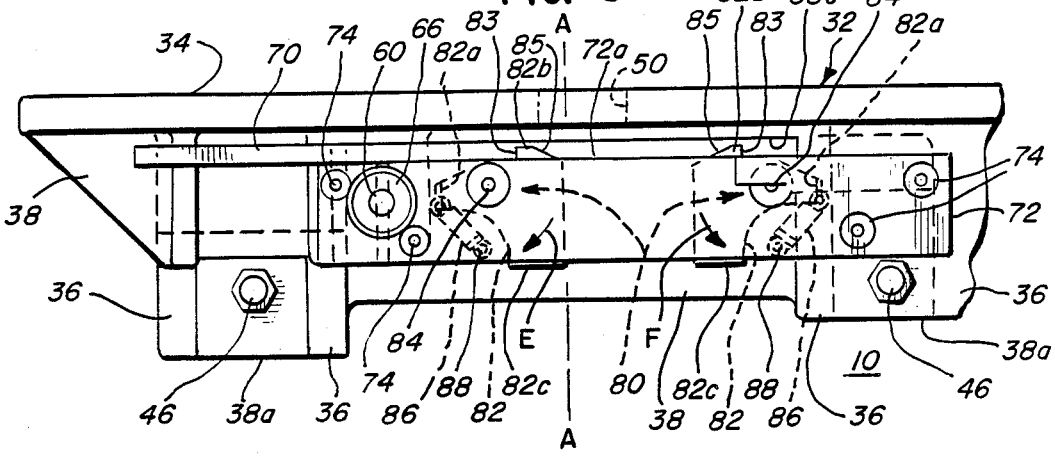
FIG. 6 is a front elevational view of the support bed in accordance with the present invention, with the right hand side of the support bed being broken away and the view being oriented to show the bed disposed in upright relation.
Figure 7:
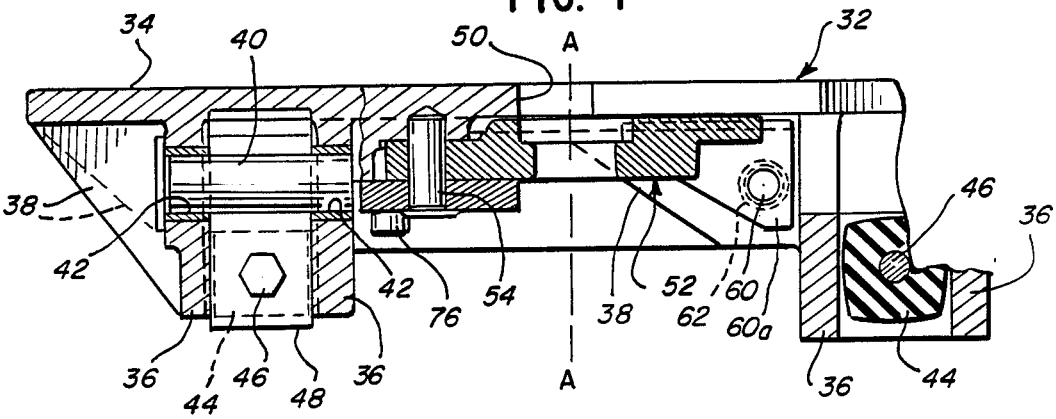
FIG. 7 is a fragmentary lateral cross sectional view of the support bed of the hitch assembly taken substantially along line 7—7 of FIG. 5, with the lateral entry slot side of the support bed being partially broken away and the view being oriented to show the support bed disposed in upright relation.
Figure 8:
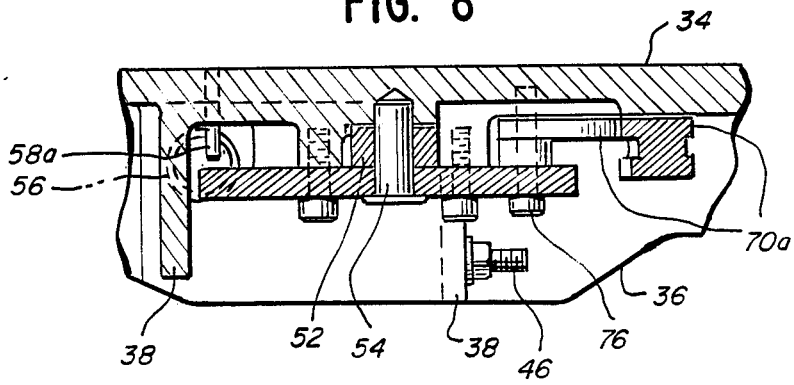
FIG. 8 is a fragmentary longitudinal cross sectional view of the hitch assembly taken substantially along line 8—8 of FIG. 5, looking in the direction of the arrows, and with the view being oriented to show the support bed horizontally disposed in upright relation.

Referring now more particularly to the drawings, a new and improved hitch assembly constructed in accordance with the features of the present invention is illustrated in detail in FIGS. 4–8 and referred to generally by the reference numeral 10. The hitch assembly 10 is especially designed and adapted for securing a forward end portion of a semi-trailer van 12 while positioned on a railroad flat car 14 in piggy-back fashion.

As illustrated best in FIG. 2, customarily railroad flat cars have a long rectangular base or load platform 16 and guide tracks 18 are provided thereon so as to generally align a semi-trailer van with a longitudinal axis "A—A" (see FIG. 5) parallel with a longitudinal, central axis of the flat car. Customarily the semi-trailer vans 12 are unhitched from their motor tractors (not shown) and are elevated and loaded on to the platform 16 of the railroad flat cars 14 with a traveling crane 20 (FIG. 1) adapted to move the semi-trailer van longitudinally as well as laterally with respect to the flat car platform so that wheels 22 of the semi-trailer van are aligned on opposite sides of the guide tracks 18.

The hitch assemblies 10 on each flat car are movable between a lowered or retracted position (as shown in FIGS. 1 and 2) and an elevated or van supporting position (as shown in FIGS. 1 and 3) for engaging a depending kingpin 24 extending downwardly from a bed plate 26 provided on the underside of the body of the semi-trailer van. A retractable support mechanism 28 is provided for supporting each hitch assembly 10 and each mechanism includes a pair of upstanding legs 30. The support mechanisms 28 may be of the type shown and described in Bock U.S. Pat. No. 3,127,142, which patent is incorporated herein by this reference.

In accordance with the present invention the hitch assembly 10 includes a support bed structure 32 of generally rectangular shape as shown best in FIG. 5 having a flat or planar upper surface 34 for supporting engagement with the bearing or bed plate 26 on the underside of the semi-trailer van. The bed structure 32 includes integrally formed stiffening ribs 36 depending downwardly from the underside of the plate and extending longitudinally and parallel of the center axis "A—A" which axis thus defines the longitudinal center line of the hitch assembly bed structure 32.

In addition to the longitudinal stiffening ribs there are provided on the underside of the bed structure 32 a plurality of depending laterally extending stiffening ribs 38. The support bed structure 32 is pivotally secured to upper end portions of the support legs 30 of the retracting support mechanism 28 by means of pivot pins 40 journalled in bearing sleeves 42 provided in apertures formed in the ribs 36.

A pair of resilient shock absorbers 44 is provided for engagement with upper forward edges of the support legs 30 and these shock absorbers are positioned between parallel adjacent longitudinal ribs 36 and are supported on elongated, headed bolts 46 which project through short, lateral, stiffening ribs **38*a* directly facing forward edge faces 30*a* of the upright support posts 30 of the mechanism 28 when the posts are in a vertical position (FIG. 4). Each shock absorber 44 includes a vertical plate 48 of rectangular shape (FIGS. 4 and 7) which extends upwardly of the bolt 46 for contact with a rounded upper edge face portion 30*b* (FIG. 4) on the adjacent support leg 30**.

In accordance with the present invention, the support bed structure 32 is formed with an elongated lateral kingpin entry slot 50 having a central axis "B—B" generally transverse to the bed longitudinal axis "A—A" and intersecting therewith at a central point "C" (FIG. 5) generally positioned in the central portion of the bed upper bearing surface 34 as best shown in FIG. 5. The lateral slot 50 is formed with an outer portion having opposite surfaces **50*a* diverging away from one another outwardly to form a large entry mouth opening at a longitudinal side edge of the bed plate structure 32 in order to receive the kingpin 24 of a semi-trailer van. The lateral slot 50 defined by the bed 32 includes parallel opposite side edges 50*b* intermediate its length joining the outwardly diverging surfaces 50*a* at the slot outer end with a slot curvilinear, inner end portion 50*c* that is in coaxial alignment with the intersection point "C" of the longitudinal axis "A—A" and the lateral or transverse axis "B—B" as best shown in FIG. 5**.

The intermediate parallel slot surfaces **50*b* defined by bed 32 are spaced apart by a distance slightly greater than the outer diameter of an upper segment 24***a* of the kingpin 24 to permit free exit and entry of the pin 24 along the intermediate portion of the bed lateral slot 50. The curvilinear inner portion 50*c* of the lateral slot 50 is of open circular configuration (see FIG. 5) having a diameter slightly greater than that of the kingpin segment 24*a* to permit limited movement of the kingpin 24 when seated therein. The kingpin 24 conventionally includes a portion 24*b* having a diameter less than that of the upper portion 24*a* and an enlarged portion 24*c* having a diameter substantially the same as the kingpin segment 24*a* as shown in FIG. 4.

The divergent outer end surfaces 50*a* of the lateral slot 50 in the bed plate structure 32 provide a large open mouth defined by the bed surfaces 50*a* that guide the kingpin 24 toward the bed entry slot narrow parallel intermediate surfaces 50*b* leading into the bed central curvilinear portion 50*c*. Opposite forward and rear surfaces of the bed curvilinear central portion 50*c* of the slot 50 provide positive fixed stop surfaces for engaging the pin 24 of a semi-trailer, which stop surfaces are defined by and are part of bed 32. Because these stop surfaces are relatively large and are a fixed part of bed 32, rather than being part of a movable element such as a latch or the like, there is no danger of a kingpin 24 once engaged from become disengaged from the bed plate structure 32 when large shock loads are encountered in a longitudinal direction.

In prior art hitch assemblies having a longitudinally oriented entry slot rather than a lateral slot, as in the present invention, shock loads in a longitudinal direction had to be absorbed by a latching mechanism resulting in the possibility of failure when extreme loads were encountered. In the hitch assembly 10 of the present invention because the stop surfaces of the central portion 50*c* of the slot 50 are a fixed part of the bed 32 are backed up by extensive thickness of metal of the bed plate are structure 32, there is little or no danger of the kingpin 24 becoming disengaged from the hitch assembly when extreme longitudinal shock loads are encountered.

In accordance with the present invention, the hitch assembly 10 is provided with a hooked shape latch element 52 for preventing a kingpin 24 from inadvertently becoming disengaged from the central portion 50*c* of the lateral slot 50. The latch element 52 is secured to the bed plate structure 32 below its upper surface 34 as well as the bed portions defining the entry slot inner end 50*c* on a depending pivot pin 54 for movement about a pivot axis aligned with the bed lateral or transverse axis "B—B", and that is normal of the plane of the bed surface 34 (see FIG. 5) between a kingpin engaging latching position (see the solid line position of FIG. 5), and an open position (see the broken line position of FIG. 5). When latch element 52 is in its open position, the lateral slot 50 is clear for relative movement of a kingpin 24 into or out of a seated position in the central segment 50*c* of the lateral slot.

The latch element 52 is biased toward a closed position by a coil spring 56 having loops at opposite ends secured around a fixed pin 58*a* and a pin 58*b* mounted on the latch element 52 as shown in FIG. 5. The latch element 52 includes a flange 52*a* (see FIGS. 5 and 7) intermediate its length having a semi-circular surface of slightly larger diameter than the intermediate segment 24*b* of the kingpin 24 to provide tight holding engagement of the pin 24 within the bed slot segment 50*c*. A blind end surface of the segment 50*c* of the lateral slot 50 provides the positive fixed stop for lateral pin forces acting along the axis "B—B" in one direction and a portion of the latch element flange 52*a* engaging the pin 24 provides a stop surface in an opposite lateral direction.

The pivot pin 54 of the latch element 52 is strong and able to well withstand any contemplated lateral forces transmitted thereto because of an engaged kingpin 24 tending to move outwardly towards the open end of the lateral slot. These forces are transmitted through the body of the hook shaped latch element 52 which is relatively thick and strong. The lower end flange 24*c* of the kingpin 24 is disposed below the underside of the latch element 52 and is larger in diameter than the latch element flange 52*a* so that the kingpin 24 cannot move upwardly and out of the engaged position once the latch is closed.

The hook shaped latch element 52 includes a first outer camming surface 52*b* facing outwardly towards the open end of the lateral slot 50 when the latch element is in the closed position as shown in FIG. 5. In addition, the latch element includes a second cam surface 52*c* on a forward edge face thereof divergent from the cam surface 52*b*. If the latch element 52 is in a closed position and there is no kingpin engaged within the slot 50, the latch element 52 will automatically open against the bias of the spring 56 as kingpin 24 engages the cam surface 52*b* on inward movement into the slot 50 along the axis "B—B". As this occurs, the latch element 52 is biased in a clockwise direction (in the showing of FIG. 5) toward an open position until the kingpin 24 moves inwardly of the outer edge of the slot surface 52*a* of the latch member 52. As this occurs, the spring 56 is then effective to move the latch element 52 into the closed position of FIG. 5 retaining the kingpin 24 in engaged position against longitudinal or lateral displacement out of the circular segment 50*c* of the lateral slot 50 in the bed plate structure 32.

In accordance with the present invention, the cam surface 52*c* of the latch element 52 is adapted to engage a finger 60*a* provided adjacent the inner edge of an indicator rod 60 mounted for reciprocal longitudinal sliding movement (FIG. 5) as indicated by the arrow D. The rod 60 is secured for longitudinal sliding movement within spaced apertures 38*b* formed in coaxial alignment in adjacent transverse or lateral ribs 38 as shown in FIG. 5. The indicator rod 60 is biased inwardly of the bed structure 32 by a coil spring 62 that is in coaxial relation around the rod 60 and has an inner end portion contained within a coaxial tubular element joined with the finger 60*a* at the inner end as shown in FIG. 5.

As the latch element 52 is pivoted toward an open position as shown in broken lines in FIG. 5, the cam surface 52*c* thereof engages the indicator rod finger 60*a* and moves the rod 60 outwardly longitudinally in the direction of the arrow D. The outer end of the rod 60 is provided with an indicator element 66, and when this element is displaced outwardly of a forward edge of the bed plate structure 32, it provides an indication to a workman that the latch element 52 is in an open position. When the indicator element 66 is in a position flush with the forward edge of the bed plate structure 32 as shown in FIG. 5, it provides an indication that the latch element 52 is closed.

It will thus be seen that the latch element 52 is biased toward the closed position but can be moved to an open condition in order to receive a kingpin by action of the kingpin upon inward movement into the slot 50 to engage the cam surface 52*b* and pivot the latch element to the open position until the kingpin is seated in the central segment 50*c* of the slot. When once seated in this position, the latch element 52 is then closed by the force of the bias spring 56 and the indicator 66 again indicates that the latch element is closed.

In accordance with the present invention, the latch element 52 is interconnected through a slotted link 68 to a manual actuating lever 70 having a free outer end projecting forwardly of a forward rail or face plate 72 extending transversely across the bed plate structure at the forward edge. The face plate 72 is secured to lateral ribs 38 by cap screws 74 and includes a horizontal upper edge 72*a* spaced below a slotted segment 38*c* in the forward lateral rib 38 of the bed plate structure 32 to provide an elongated slot or opening for the outwardly extending portion of the manual actuating lever 70.

The actuating lever 70 includes a goose neck shaped inner end portion 70*a* pivotally secured at its inner end to on a pivot pin 76 depending downwardly of the bed plate structure 32. As shown in FIG. 5, the manual actuating lever 70 is pivotable from a latch closed position (shown in solid lines) in a clockwise direction to a latch open position (shown in broken lines), and as shown, the outer end portion of the lever 70 also provides an indication of the position of the latch element 52.

An inner end of the slotted link 68 is pivotally connected to an ear 52*d* of the latch element 52 by a pin 78. An outer end portion of the link 68 is formed with an elongated lost motion slot 68*a* accommodating a connector pin 79 extending through the slot and supported on the manually actuated arm 70 intermediate its ends.

As illustrated in FIG. 5 with the manual actuating lever 70 in the latch closing position as shown in solid lines the latch element 52 is normally in the closed position and the connection between the pin 79 and slot 68*a* of the slotted linkage lever 60 permits movement of the latch element 52 from the closed to the open position without any corresponding movement of the manual actuating lever 70 being required. The lost motion connection between the latch element 52 and actuating lever 70 readily permits movement of the latch element 52 between open and closed positions as described without requiring corresponding movement of the actuating lever 70 which may remain in a latched closing position as shown. It will also be noted that when the hitch assembly 10 is subjected to shock loads acting longitudinally of the car (on which a semi-trailer van 12 is mounted for rail transit using hitch assembly 10 in the manner disclosed herein), latch element 52 is free to articulate about its pivot pin 54, as will be apparent from the Applicant's drawings (see, for instance, FIGS. 5 and 7), so that such shock loads are applied to the indicated fixed stop surfaces of the bed central portion 50*c* (in fore and aft directions, as the case may be) along axis "A—A".

When it is desired to manually open the latch element 52, the outer end portion of the actuating arm 70 is manually grasped and moved in a clockwise direction about pivot pin 76 to an ultimate latch open position as shown in broken lines in FIG. 5. As this occurs, the pin 79 engages the outer end of the slot 68*a* and cuases the latch element 52 to pivot in a clockwise direction into the latch open position as shown in broken lines, where it is retained against the biasing force of the spring 56 by the manual actuating lever 70. In order to retain and latch the actuating lever 70 in either an open or closed position as shown, a pair of lever latch assemblies or mechanisms 80 are mounted at spaced locations on the forward rail 72. Each latch mechanism 80 includes a latch member 82 mounted for pivotable movement on a pivot pin 84 provided on the rail or face plate 72. Each latch member 82 is biased toward a latching position by a coil spring 86 having a loop at the upper end connected to a lug 82*a* of latch member spaced radially outward of the pivot pin 84 thereof. A loop at the lower end of each bias spring 86 is secured to a pin 88 FIG. 6 mounted on the forward rail 72 so that as viewed in FIG. 6 the respective latch members 82 are biased in opposite directions about the respective mounting pins 84 toward a latching position for securing the manual actuating arm 70 in either a latch open or latch closed position outboard of an upstanding lug 82*b* of the respective latch members 82.

As illustrated in FIG. 6, the upstanding lugs 82*b* of the respective latch members 82 extend upwardly above the upper edge 72*a* of the forward rail 72 for engagement with a side edge of the manual actuating lever 70. For this purpose the lugs 82*b* of each latch member include an upstanding arm engaging edge surface 83 and a downwardly and inwardly sloping cam surface 85 adapted for interaction with an edge of the manual actuating lever 70 as it is moved toward a latching position at an outer end of the slot 38*c*.

Referring now specifically to FIGS. 5 and 6, when the manual actuating arm or lever 70 is in a latch member closed position as illustrated, the arm or lever 70 is retained in the latch closed position by engagement of an edge of the arm or lever 70 with an upstanding latch surface 83 on the latching lug 82*b* of the right hand latch element 82 as shown in FIG. 6. The right hand latch element or member 82 is biased in a clockwise direction as viewed in FIG. 6 by its latch spring 86, and in order to release indicated the latch member 82, a lug 82*c* at the lower end is manually pressed downwardly to permit pivoting movement of the latch member 82 in question in the direction of the arrow "F".

After depression of the latching lug 82*c* so that the upper end of the lug 82*b* (of the latch member 82 in question) moves below the lever 72*a* of the rail, the manual actuating lever 70 can be moved from right to left as viewed in FIG. 6 (clockwise direction as viewed in FIG. 5) toward an opposite latching assembly 80 on the left hand side of the forward rail 72 as viewed in FIG. 6. As this occurs, manual lever 70 engages the sloping surface 85 on the lug 82*b* of the left hand latch element or member 82 causing the element or member 82 to pivot in a clockwise direction as indicated by the arrow "E". This movement continues until the lever 70 moves past the surface 83 of the indicated latch element or member 82 at which time the latch element or member 82 in question is then biased by its spring 86 to pivot in a clockwise direction (FIG. 6) to move upwardly so that the edge surface 83 will engage and hold the edge of the manual arm 70 in the latch element opening position as shown in dotted lines in FIG. 5.

With the arm or lever 70 in the latch open position as described, the latch element 52 is retained in the open position as shown in broken lines FIG. 5 so that a kingpin 24 may be moved into or out of the lateral slot 50 as previously described. The latch activating arm 70 may then be moved from the latch open position back to the latch closed position by depressing the release stop lug 82*c* on the left hand latch element 82 (FIG. 6) to pivot the indicated latch element or member 82 in a clockwise direction as shown by the arrow "E" and then the manual actuating lever 70 may be moved from left to right until it is back into the latch closed position.

Another the present invention has been described with reference to an illustrated embodiment thereof, it should be understood that numerous other modifications and embodiments can be made by those skilled in the art that will fall within the spirit and scope of the principles of this invention.

What is claimed as new and desired to be secured by Letters Patent is:

1. A fifth wheel plate structure for a elevatable hitch assembly for anchoring a semi-trailer van kingpin to a railroad car for rail transit of the van on the car, said fifth wheel plate structure comprising, for improving the restraint exercised on the van kingpin against loadings acting forwardly and rearwardly of the car during rail transit, a bed plate including an upwardly facing bearing surfacing having a relative large planar area for load supportive engagement with the van when the van rests on the hitch assembly fifth wheel plate structure and that defines a kingpin receiving opening and front, rear and side bed portions forming the perimeter of said fifth wheel plate structure, with said bed plate front and rear portions at and adjacent the fifth wheel structure kingpin receiving opening including integral, thrust resisting, bed structures that are fixed relative to said bed, said front and rear plate bed structure portions defining front and rear stop surfaces at the fifth wheel structure kingpin receiving opening that are in opposed relation forwardly and rearwardly of the hitch assembly bed plate, and that are configured to together define a kingpin receiving pocket that receives the van kingpin in close fitting relation thereto when the kingpin is received therein, and that are backed up by said fixed bed structures, respectively, said bed plate further defining a kingpin entry slot extending to and between the said bed kingpin receiving pocket from and through one of the bed plate side portions, said bed plate kingpin entry slot having its mouth open at the side of the fifth wheel structure that said bed one side portion is on and extending substantially laterally of the forward and rearward thrusts to be resisted when the van is in rail transit, said bed plate entry slot being proportioned to pass the van kingpin along the length thereof between said stop surfaces at the kingpin receiving pocket and said one side portion of said bed, and through said bed one side portion, and a latch mechanism for latching the van kingpin to said bed plate, said latch mechanism comprising:

latch means operatively connected to said bed plate below said bearing surfacing of same and including a latch member defining latch surfacing proportioned to, in the closed position thereof, latchingly engage the kingpin across said plate entry slot when the kingpin is disposed within said pocket, said latch member being articulated to said bed plate for shifting forwardly and rearwardly of said bed plate relative to said pocket when thrust loadings acting forwardly and rearward of the car are experienced during the rail transit, whereby said stop surfaces are respectively backed up by said bed plate structures and resist said forwardly and rearwardly acting thrust loadings to the substantial exclusion of said latch member.

2. In a hitch assembly for mounting piggyback fashion on a load supporting platform of a railroad flatcar, for transportation by rail, a rear wheel assembly equipped semi-trailer van of the type having adjacent the forward end of the van a downwardly facing fifth wheel bearing plate that is equipped with a depending kingpin aligned with the longitudinal centerline of the semi-trailer van, with the hitch assembly being retractably mounted on the flatcar for releasably securing the van on the car at the van kingpin in position for such rail transportation, with the van resting on its rear wheel assembly on the car for such transportation, and with the hitch assembly including a fifth wheel plate structure, means for raising and lowering the hitch assembly fifth wheel plate structure between an elevated van supporting position in which the van fifth wheel bearing plate will rest on the hitch fifth wheel plate structure when the van is at said elevated position and a lowered retracted position on the flatcar platform, including means for releasably fixing said fifth wheel plate structure in its elevated position for supporting the van when the van fifth wheel plate rests on the hitch fifth wheel structure, with the hitch fifth wheel plate structure defining a centrally located kingpin receiving opening located in substantial alignment with the longitudinal centerline of the plate structure in which the van kingpin is to be disposed when the van is in said position, and the fifth wheel plate structure having front and rear portions disposed on either side of the kingpin receiving opening and first and second side portions disposed on opposite sides of the kingpin receiving opening, with said plate structure portions defining the perimeter of the plate structure thereabout, with the plate structure also defining a kingpin entry slot communicating between the kingpin receiving opening and the perimeter of the plate structure including a mouth at the plate structure perimeter for passing the kingpin between the plate structure opening and the plate structure perimeter and out of and into the entry slot mouth, and a latch mechanism for releasably locking the van kingpin to the hitch assembly fifth wheel structure, when the hitch assembly is fixed in its raised position with the van fifth wheel bearing resting on the hitch fifth wheel plate structure with its kingpin disposed in the hitch fifth wheel plate structure kingpin receiving opening for restraining the van against movement forwardly and rearwardly of the flatcar during the rail transport, the improvement wherein:

the hitch assembly fifth wheel plate structure comprises, for improving the restraint exercised on the van kingpin against loadings acting forwardly and rearwardly of the flatcar, a bed plate including an upwardly facing bearing surfacing having a relative large planar area for load supportive engagement with the van fifth wheel bearing plate when the van fifth wheel plate rests on the hitch assembly fifth wheel plate structure and that defines the hitch fifth wheel plate structure kingpin receiving opening and the fifth wheel plate structure front, rear, and side portions, with said bed plate front and rear portions at and adjacent the fifth wheel structure kingpin receiving opening including integral, thrust resisting, bed structures that are fixed relative to said bed, said front and rear plate bed structure portions defining front and rear stop surfaces at the fifth wheel structure kingpin receiving opening that are in opposed relation forwardly and rearwardly of the hitch assembly bed plate, and that are configured to together define a kingpin receiving pocket that receives the van kingpin in close fitting relation thereto when the kingpin is received therebetween in said position of the van, and that are backed up by said fixed bed structures, respectively, said bed plate further defining the kingpin entry slot to extend to and between the said bed kingpin receiving pocket from and through one of the bed plate side portions, said bed plate kingpin entry slot having its mouth open at the side of the hitch assembly fifth wheel structure that said bed plate one side portion is on and extending substantially laterally of the forward and rearward thrusts to be resisted when the van is in said position and in rail transit, said bed plate entry slot being proportioned to pass the van kingpin along the length thereof between said stop surfaces at the kingpin receiving pocket and said one side portion of said bed, and through said bed one side portion, said latch mechanism comprising:

latch means operatively connected to said bed plate below said bearing surfacing and including a latch member defining latch surfacing proportioned to, in the closed position thereof, latchingly engage the kingpin across said plate entry slot when the van is disposed in said position and its kingpin is disposed within said pocket, said latch member being articulated to said bed plate for shifting forwardly and rearwardly of said bed plate relative to said pocket when in said closed position thereof and when thrust loadings acting forwardly and rearward of the flatcar are experienced during the rail transportation, whereby said stop surfaces are respectively backed up by said bed plate structures and resist said forwardly and rearwardly acting thrust loadings to the substantial exclusion of said latch member.

3. The improvement set forth in claim 2 wherein:

said bed plate pocket is centered substantially along the longitudinal centerline of the hitch assembly fifth wheel plate structure, and defines an axial center located on the hitch assembly fifth wheel plate structure longitudinal centerline.

4. The improvement set forth in claim 3 wherein said latch member of said latching means comprises:

a hook element having one end of same pivotally mounted on said bed plate to pivot about a pivot axis disposed to one side of said bed plate pocket that is coplanar with said pocket center in a first plane that extends transversely of the fifth wheel plate structure longitudinal centerline and normally of said bed plate bearing surfacing, said hook element defining a hook arm that extends around said pocket, in a second plane that is below the level of said bed plate stop surfaces, and across the entry slot on the other side of the bed plate pocket and substantially normally of said first plane, to define said closed position of said latch member, said hook element being movable about said pivot axis thereof between said closed position and an open position in which the entry slot is free of said hook arm for free passage of the van kingpin between said bed plate pocket and the entry slot mouth, and means for biasing said hook element to said closed position of said latch member.

5. The improvement set forth in claim 4 wherein:

said hook element includes means for kingpin camming said hook element from said closed position thereof to said open position thereof when said pocket is free of a van kingpin, and a van kingpin is moved toward said pocket from the fifth wheel plate structure perimeter through said entry slot for seating such kingpin is said pocket.

6. The improvement set forth in claim 5 wherein:

said plate structure includes an indicating member mounted in said bed plate at the perimeter of the fifth wheel plate structure for movement below the plane of said bed plate bearing surfacing between a retracted position adjacent the bed plate and an extended position projecting from said bed plate, said indicating member being biased to its retracted position, said hook element including means for camming said indicating member to said extended position when said hook element is moved to said open position for indicating that said hook element is in its said closed position.

7. The improvement set forth in claim 5 wherein:

said hook element swings forwardly of the bed plate about its said pivot axis in moving from its said closed position to its said open position.

8. The improvement set forth in claim 7 including:

a lever for manually moving said hook element between said positions thereof, said lever comprising an arm mounted for movement in a plane that is below and parallel to the plane of said bed bearing surfacing, said lever arm having one end pivotally mounted on said bed plate to pivot about an axis located forwardly of and to said one side of said bed plate pocket paralleling said hook element pivot axis, said lever arm other end extending externally of said bed plate at the front portion of said bed plate, and a linkage connecting said arm intermediate said ends thereof with said hook element for movement between said closed and open positions thereof, said linkage including lost motion connection means for accommodating said kingpin camming of said hook element from said closed position thereof to said open position thereof.

9. The improvement set forth in claim 8 including:

means for releasably latching said lever arm in its respective positions wherein said hook element is in its said closed position and wherein said hook element has been manually shifted to said open position by utilizing said lever.

10. The improvement set forth in claim 2 wherein:

said means for raising and lowering said fifth wheel plate structure comprises a pair of coplanar legs having like ends of same pivotally connected to the underside of said bed plate on either side of said bed plate pocket for pivotal movement about aligned axes extending transversely of said bed plate, and including shock absorbing means interposed between said bed plate and the respective said like ends of said legs for cushioning thrust loadings acting forwardly and rearwardly of the flat car that are experienced during rail transit.

* * * * *